US006012949A

United States Patent [19]

Lok

[11] Patent Number: 6,012,949

[45] Date of Patent: Jan. 11, 2000

[54] ELECTRICAL CONNECTOR ASSEMBLY AND BOARDLOCKS THEREOF

[75] Inventor: Gordon Lok, Montebello, Calif.

[73] Assignee: Hon Hai Precision Ind. Co., Ltd., Taipei Hsien, Taiwan

[21] Appl. No.: 09/207,819

[22] Filed: Dec. 9, 1998

[51] Int. Cl.[7] ..... H01R 13/73

[52] U.S. Cl. ..... 439/570

[58] Field of Search ..... 439/569–573, 439/357, 358

[56] References Cited

U.S. PATENT DOCUMENTS 5,688,143 11/1997 McHugh et al. ..... 439/570

*Primary Examiner*—Gary F. Paumen

*Attorney, Agent, or Firm*—Wei Te Chung

[57] ABSTRACT

An electrical connector assembly includes a plug received in a slot defined in a receptacle which is mounted to a PC board by means of boardlocks received in passageways thereof. Each boardlock includes a main body having a plate perpendicularly extending from a bottom of an intermediate portion thereof for being soldered to the PC board. A pair of engaging wings perpendicularly project from opposite sides of the intermediate portion of the main body into the slot for engaging with apertures defined in side portions of the plug to firmly secure the plug therein. One distal end of the main body is bent to perpendicularly extend therefrom, and the other distal end of the main body is curved whereby a tail end thereof projects in a direction parallel to the main body. Thus, a force acting on the plate is effectively absorbed by the distal ends of the boardlock when the plug is withdrawn from the receptacle.

16 Claims, 4 Drawing Sheets

ELECTRICAL CONNECTOR ASSEMBLY AND BOARDLOCKS THEREOF

BACKGROUND OF THE INVENTION

1. Field of the Invention

The present invention relates to an electrical connector assembly, and particularly to an electrical connector assembly having boardlocks for securely mounting a receptacle to a PC board and for firmly engaging a plug with the receptacle.

2. The Prior Art

Electrical connector assemblies are commonly used to electrically engage an electrical device with peripheral equipment such as connecting a cellular phone to an external power supply. A conventional plug of a cable assembly engages with a corresponding receptacle by means of a snug fit between corresponding terminals thereof. In addition, an outer shape of the plug is received in a complementary space defined in the receptacle. However, such an engagement can not effectively resist an external force which may inadvertently disengage the plug from the receptacle.

The receptacle is commonly mounted to a PC board by means of boardlocks and is electrically engaged therewith through terminals surface mounted thereon. If the plug has a strong engagement with the receptacle, withdrawal of the plug may result in disengagement of the boardlocks and terminals from the PC board thereby hindering signal transmission through the electrical connector assembly.

Hence, an improved connector assembly is requisite to overcome the disadvantages of the prior art.

SUMMARY OF THE INVENTION

Accordingly, an objective of the present invention is to provide an electrical connector assembly having a strong engagement between a plug and a receptacle thereof whereby disengagement by an external force can be effectively resisted.

Another objective of the present invention is to provide an electrical connector assembly having boardlocks engaged with a receptacle and surface mounted to a PC board whereby withdrawal of a plug from the receptacle will not result in the receptacle becoming disengaged from the PC board.

To fulfill the above mentioned objectives, an electrical connector assembly in accordance with the present invention includes a plug received in a slot defined in a receptacle which is mounted to a PC board by means of boardlocks received in passageways thereof. Each boardlock includes a main body having a plate perpendicularly extending from a bottom of an intermediate portion thereof for being soldered to the PC board. A pair of engaging wings perpendicularly project from opposite sides of the intermediate portion of the main body into the slot for engaging with apertures defined in side portions of the plug to firmly secure the plug therein. One distal end of the main body is bent to perpendicularly extend therefrom, and the other distal end of the main body is curved whereby a tail end thereof projects in a direction parallel to the main body. Thus, a force acting on the plate is effectively absorbed by the distal ends of the boardlock when the plug is withdrawn from the receptacle.

These and additional objectives, features, and advantages of the present invention will become apparent after reading the following detailed description of the preferred embodiment taken in conjunction with the appended drawing figures.

DETAILED DESCRIPTION OF THE PREFERRED EMBODIMENT

Reference will now be made in detail to the preferred embodiment of the present invention.

Figure 1:
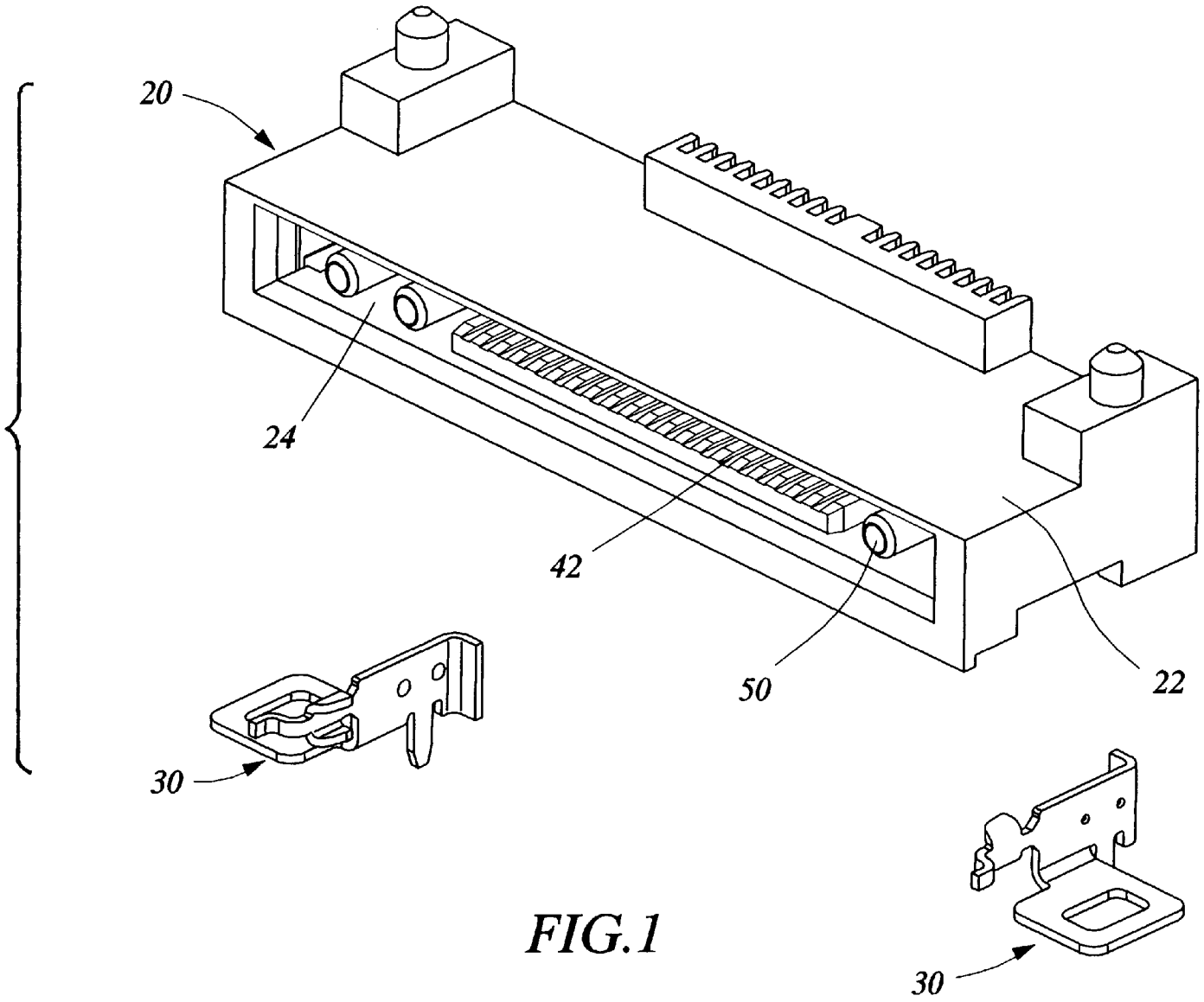
FIG. 1 is an exploded view of a receptacle in accordance with a preferred embodiment of the present invention.
Figure 2:
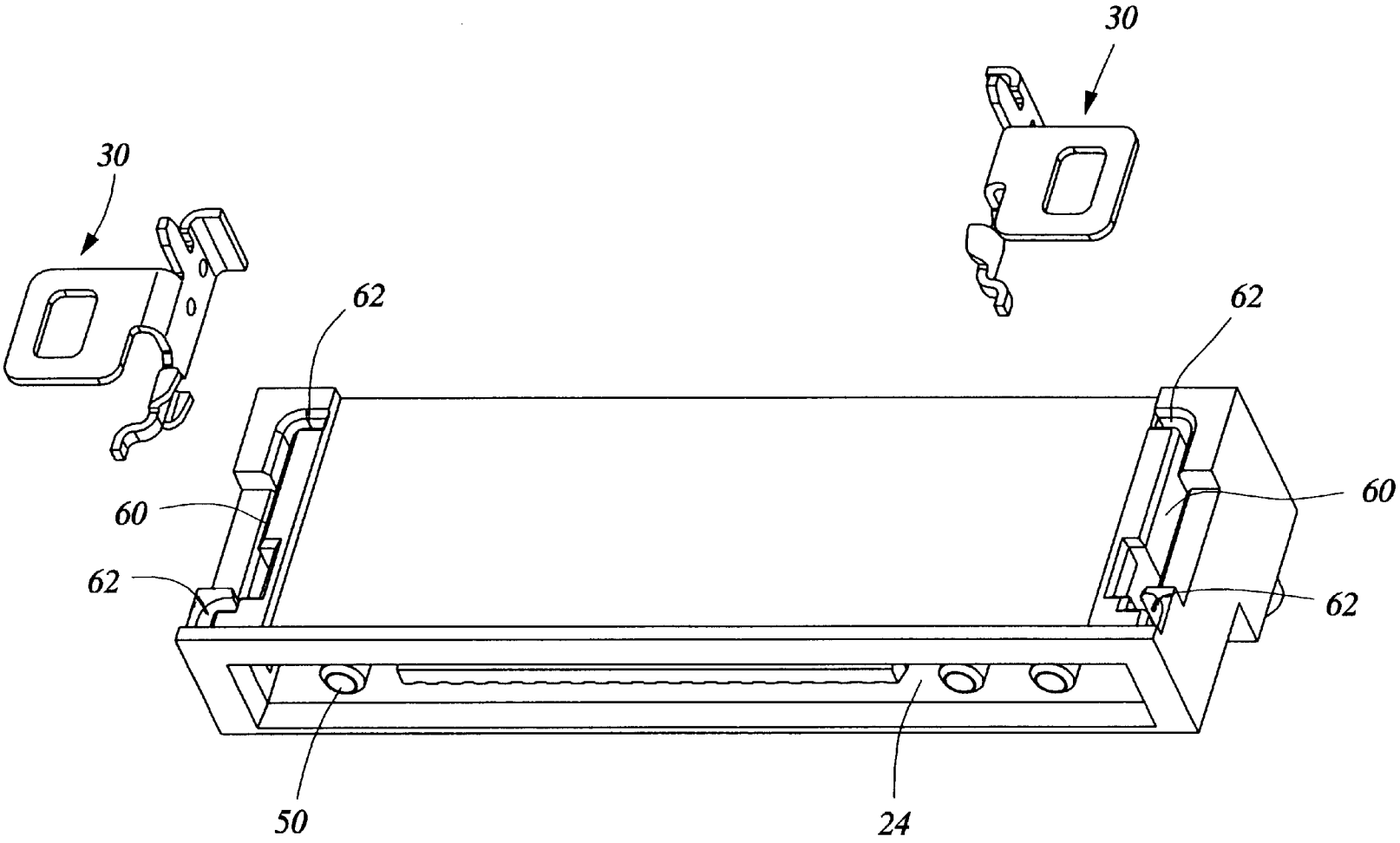
FIG. 2 is a view similar to FIG. 1 taken from a different angle.
Figure 3:
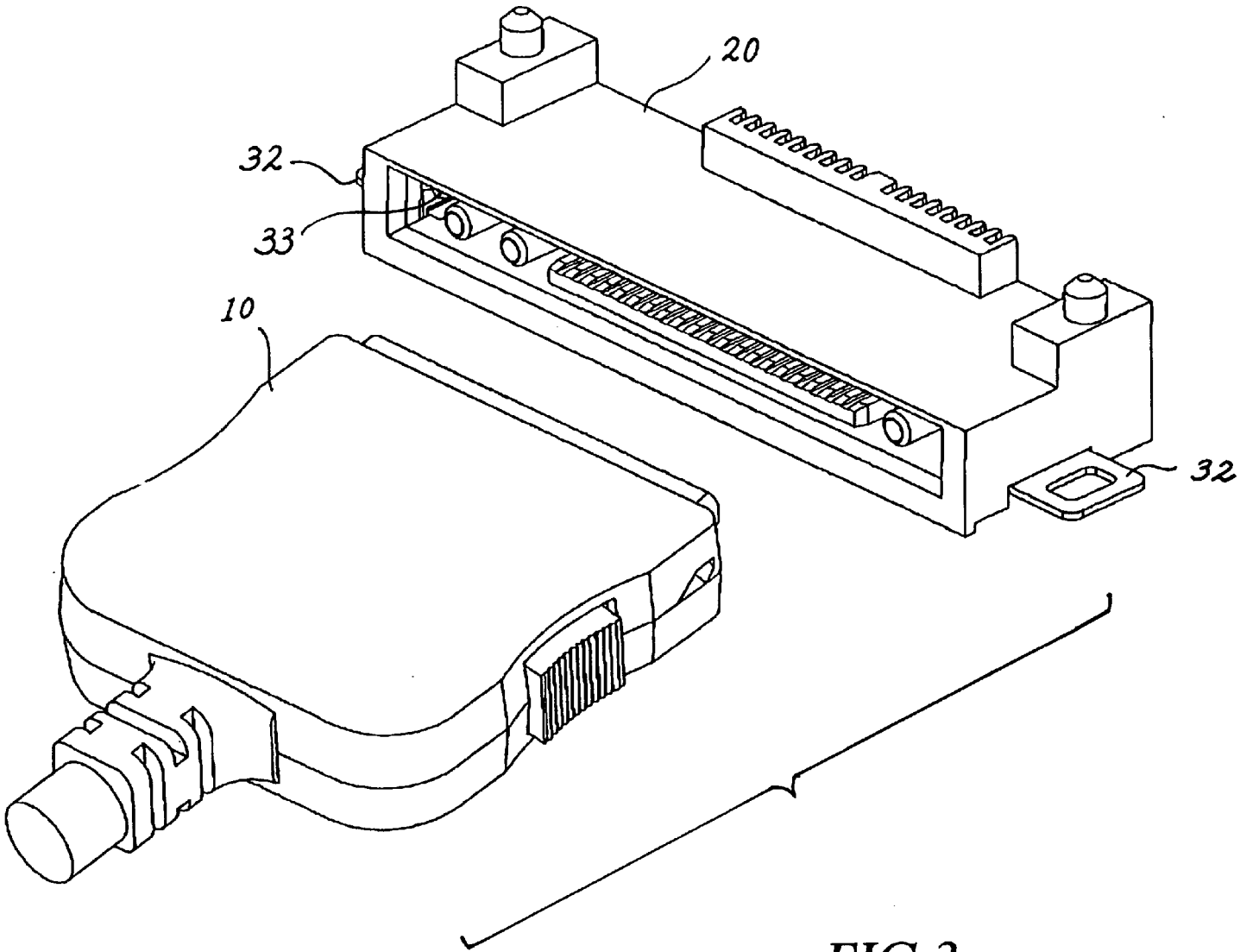
FIG. 3 is a perspective, assembled view of the receptacle of FIG. 1 and a plug to be engaged therewith.

Referring to FIGS. 1–3, an electrical connector assembly in accordance with the present invention includes a plug 10 engaged with a receptacle connector 20 which is mounted to a PC board (not shown) by means of boardlocks 30. The receptacle 20 comprises an insulative housing 22 defining a longitudinal slot 24 in a front face thereof for receiving the plug 10 therein. A plurality of terminals (not shown) are assembled into the grooves 42 of the housing 22. Contact portions (not shown) of the terminals (not shown) extend into the slot 24 at one end for engaging with corresponding contacts (not shown) of the plug 10, and tail portions (not shown) of the terminals (not shown) are surface mounted to the PC board. A coaxial connector 50 also extends into the slot 24 for engaging with a mating coaxial connector (not shown) of the plug 10. A pair of passageways 60 for receiving the boardlocks 30 are defined in a bottom face of the receptacle 20 in communication with the slot 24.

Figure 4:
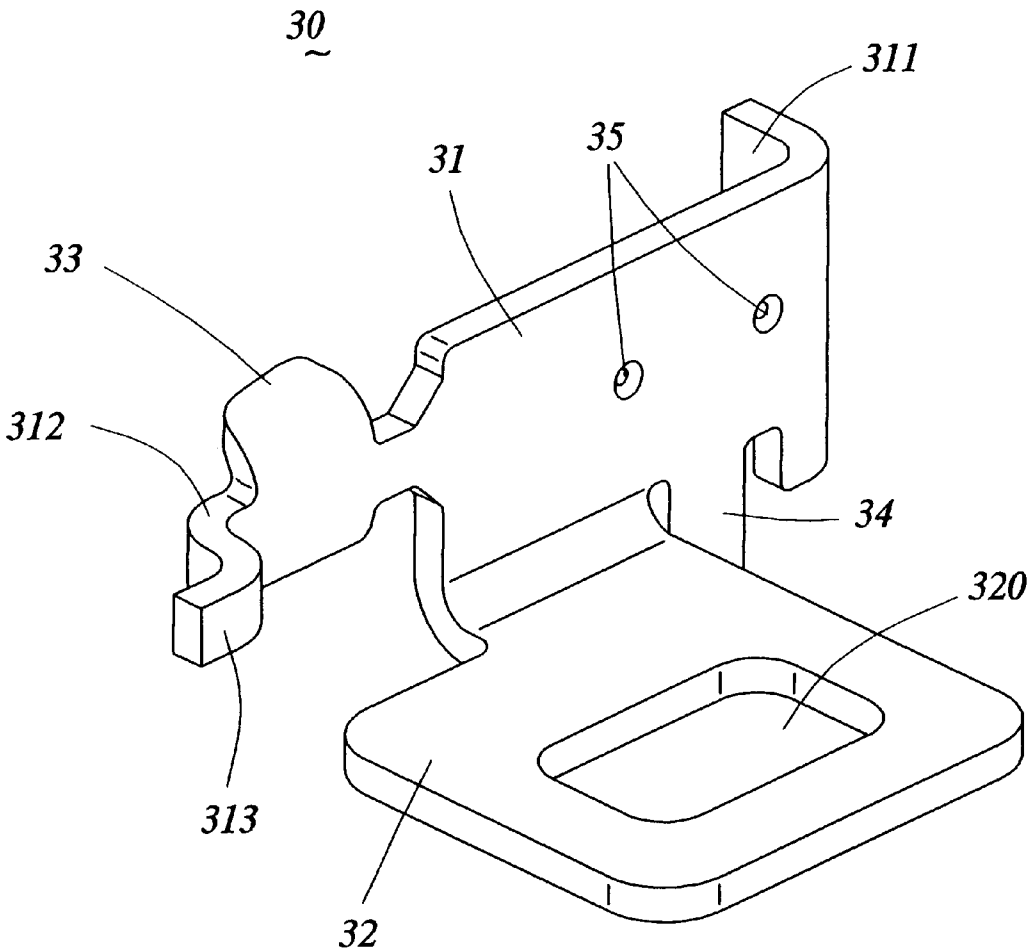
FIG. 4 is a perspective view of a boardlock in accordance with the present invention.

Referring also to FIG. 4, each boardlock 30 includes a main body 31 and a plate 32 perpendicularly extending from a bottom of an intermediate portion of the main body 31 for contacting the PC board. Each plate 32 defines an opening 320 therethrough for facilitating soldering to the PC board. A first distal end 311 of the main body 31 is bent to perpendicularly extend therefrom, and a second distal end 312 of the main body 31 is curved whereby a tail end 313 thereof projects in a direction substantially parallel to the main body 31. A pair of engaging wings 33 perpendicularly project from opposite sides of the intermediate portion of the main body 31 near the second distal end 312 in a direction opposite the extending direction of the plate 32. A post 34 for insertion into a positioning hole defined in the PC board downwardly projects from the main body 31. Two positioning protrusions 35 are formed on the main body 31 for engaging with corresponding recesses (not shown) defined within the passageways 60 of the housing 22 for properly aligning the boardlock 30 therein.

The passageways 60 are defined in the housing 22 of the receptacle 20 to fittingly accommodate the corresponding boardlocks 30. When the boardlocks 30 are inserted therein, the positioning protrusions 35 are received in the corresponding recesses, the engaging wings 33 project into the slot 24, the distal ends 311, 312 are received in corresponding channels 62 of the passageways 60, the post 34 extends beyond a bottom surface of the housing 22, and the plate 32 projects from a corresponding distal end of the housing substantially coplanar to a bottom surface thereof. The posts 34 are inserted into the corresponding positioning holes defined in the PC board and solder is applied to the PC board through the openings 320 of the plates 32 whereby the receptacle 20 is secured to the PC board.

When the plug 10 is inserted into the slot 24, the engaging wings 33 of the boardlocks 30 engage with latches (not shown) of the plug 10 for firmly securing the plug 10 therein. This arrangement can effectively resist inadvertent disengagement of the plug 10 from the receptacle 20 due to an external force. Since the distal ends 311, 312 of the main body 31 of the boardlocks 30 are substantially perpendicular to the main body 31, the distal ends 311, 312 can effectively absorb a force acting on the plates 32 of the boardlocks 30 when the plug 10 is withdrawn from the receptacle 20.

The feature of the invention is to provide a receptacle connector 20 including a boardlock 30 with an integrally formed locking engaging wing 33 for latchable engagement with the corresponding latches (nor shown) of the plug connector 10, wherein the boardlock 30 includes either a mounting plate 32 or a post 34 exposed to an exterior for securing to the PC board on which the receptacle connector 20 is seated, and the engaging wing 33 extends into the slot 24 surrounded by the periphery of the housing 22 of the receptacle 20. Another feature of the invention is to have the boardlock 30 assembled into passageway 60 of the housing 22 from the bottom. Additionally, the configuration of the passageway 60 including the corresponding channel 62 is designed to fittingly accommodate the boardlock 30 so as to efficiently resist the horizontal withdrawal forces applied to the engaging wings 33 of the boardlock 30 and to prevent relative movement between the housing 20 and the boardlock 30 along a front-to-back direction.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

I claim:

1. An electrical connector assembly including:

a receptacle comprising an insulative housing defining a longitudinal slot in a front face thereof and at least a passageway in a bottom face thereof in communication with the slot;

a plug received in the slot of the housing; and at least one boardlock received in the corresponding passageway of the housing, each boardlock including a main body having a plate extending perpendicularly from a bottom of an intermediate portion thereof for being soldered to the PC board and an engaging wing perpendicularly projecting from the intermediate portion of the main body into the slot for engaging with a latch of the plug whereby inadvertent disengagement of the plug from the receptacle due to an external force is effectively resisted.

2. The connector assembly as described in claim 1, wherein the plate defines an opening therethrough for facilitating soldering to the PC board.

3. The connector assembly as defined in claim 1, wherein the plate projects from a distal end of the housing substantially coplanar to a bottom surface thereof.

4. The connector assembly as described in claim 1, wherein the engaging wing and the plate extend from the main body in different directions.

5. The connector assembly as described in claim 1, wherein one distal end of the main body of each boardlock is bent to perpendicularly extend therefrom, and the other distal end of the main body thereof is curved whereby a tail end projects in a direction parallel to the main body.

6. The connector as described in claim 1, wherein a post downwardly projects from the main body for insertion into a positioning hole defined in the PC board.

7. The connector as described in claim 1, wherein a positioning protrusion is formed on the main body of each boardlock for engaging with a corresponding recess defined within the passageway of the housing for properly aligning the boardlock therein.

8. An electrical connector assembly including:

a receptacle comprising an insulative housing defining a longitudinal slot in a front face thereof and at least are passageway in a bottom face thereof in communication with the slot;

a plug received in the slot of the housing; and a boardlock received in each corresponding passageway of the housing from the bottom face there of, each boardlock including a main body having a curved distal end and a plate perpendicularly extending from a bottom of an intermediate portion of the main body for being soldered to the PC board, whereby the curved distal end can effectively absorb a force acting on the plate when the plug is withdrawn from the receptacle.

9. A boardlock received in a corresponding passageway of an electrical connector from a bottom face thereof and for mounting the connector to a PC board, comprising:

a main body having a plate perpendicularly extending from a bottom of an intermediate portion thereof for being soldered to the PC board; and at least an engaging wing perpendicularly projecting from the intermediate portion of the main body for latching to a mating plug; wherein the engaging wing and the plate extend from the main body in different directions; and wherein a post projects downwardly from the main body for insertion into a positioning hole defined in the PC board.

10. The boardlock as described in claim 9, wherein the main body includes a curved distal end.

11. The boardlock as described in claim 10, wherein one distal end of the main body of the boardlock extends perpendicularly therefrom and another distal end has a tail end projecting in a direction parallel to the main body.

12. The boardlock as described in claim 9, wherein the plate defines an opening therethrough for facilitating soldering to the PC board.

13. A receptacle connector comprising:

an insulative housing defining a longitudinal slot in a front face thereof and at least one passageway in a bottom face thereof in communication with the slot; and a boardlock assembled into the passageway from a bottom of the housing, said boardlock including first means for securing to a PC board on which the receptacle connector is seated, and second means for latchable engagement with latches of a complementary plug connector; wherein said first means is exposed to an exterior of the housing and said second means extends into the slot of the housing.

14. The receptacle connector as defined in claim 13, wherein a configuration of the passageway is snugly compliant with the boardlock for efficiently resisting a horizontal withdrawal force applied to the second means of the boardlock.

15. The receptacle connector as described in claim 13, wherein said first means is either a horizontal mounting plate or a vertical post.

16. The receptacle connector as described in claim 13, wherein said second means is an engaging wing.

* * * * *